US009218797B2

(12) United States Patent
Flicek

(10) Patent No.: US 9,218,797 B2
(45) Date of Patent: Dec. 22, 2015

(54) PERCUSSION INSTRUMENT

(71) Applicant: Brian G. Flicek, Harris, MN (US)

(72) Inventor: Brian G. Flicek, Harris, MN (US)

(73) Assignee: Brian G. Flicek, Harris, MN (US)

( * ) Notice: Subject to any disclaimer, the term of this patent is extended or adjusted under 35 U.S.C. 154(b) by 0 days.

(21) Appl. No.: 14/536,045

(22) Filed: Nov. 7, 2014

(65) Prior Publication Data

US 2015/0128786 A1 May 14, 2015

Related U.S. Application Data

(60) Provisional application No. 61/901,629, filed on Nov. 8, 2013.

(51) Int. Cl.
*G10D 13/08* (2006.01)
*G10D 13/06* (2006.01)
*G10D 13/00* (2006.01)

(52) U.S. Cl.
CPC ..... *G10D 13/08* (2013.01); *G10D 13/00* (2013.01); *G10D 13/06* (2013.01)

(58) Field of Classification Search
CPC ..... G10D 13/08; G10D 13/00
USPC ..... 84/402
See application file for complete search history.

(56) References Cited

U.S. PATENT DOCUMENTS 471,046 A * 3/1892 Wilskey ..... A63H 5/00 273/330
581,780 A * 5/1897 Shaaber ..... G10K 1/0645 116/148
1,276,839 A * 8/1918 Weber ..... G10D 13/08 84/403
1,838,502 A * 12/1931 Schluter ..... G10D 13/08 84/403
2,738,697 A * 3/1956 Miller ..... G10K 1/072 84/404
3,595,119 A * 7/1971 Kuijpers ..... G10D 13/08 84/403
4,362,080 A * 12/1982 DeArmas ..... G10K 1/07 116/170
4,779,507 A * 10/1988 Shimoda ..... G10D 13/06 84/402
D298,543 S * 11/1988 Benson ..... 84/402
4,885,972 A * 12/1989 Chen ..... G10D 13/08 84/403
4,898,061 A * 2/1990 Cohen ..... G10D 13/06 84/402
4,901,617 A * 2/1990 Malone ..... G10D 13/06 84/402

(Continued)

FOREIGN PATENT DOCUMENTS

WO 93/18503 A1 9/1993

OTHER PUBLICATIONS

Search Report and Written Opinion for PCT/US2014/64610, dated Feb. 6, 2015, 8 pages.

*Primary Examiner* — David Warren
*Assistant Examiner* — Christina Schreiber
(74) *Attorney, Agent, or Firm* — Skaar Ulbrich Macari, P.A.

(57) ABSTRACT

The present invention provides a percussion instrument that is struck by a drumstick and generates a sound resembling a cross between a cowbell and a xylophone. The instrument comprises two spaced-apart planar metal plates with three of the sides spanning between the plates enclosed by additional metal plates. The additional metal plates are welded to the spaced-apart metal plates at discreet locations to tune the instrument. An aperture for a tom mount can be defined in one of the planar metal plates. In certain embodiments, the instrument is approximately 30-38 inches long with one end being 6-16 inches across and the opposing end being 2-3 inches across. The spacing between the spaced-apart metal plates in certain embodiments is 1-2.5 inches. Welds in certain embodiments can be arranged to generate a plurality of different pitches, for example, five different pitches.

20 Claims, 8 Drawing Sheets

(56) References Cited

U.S. PATENT DOCUMENTS

D321,528 S * 11/1991 Cohen ..... D17/22
5,207,769 A * 5/1993 Malta ..... A63H 5/00 446/418
D336,101 S * 6/1993 Lewis ..... D17/22
5,639,976 A * 6/1997 Manoff ..... G10D 13/06 84/402
5,814,747 A * 9/1998 Ramsell ..... A63H 5/00 446/418
5,854,436 A * 12/1998 Wernick ..... G10H 3/146 84/411 P
D409,649 S * 5/1999 Cohen ..... 84/402
6,020,546 A * 2/2000 Cohen ..... G10D 13/06 84/402
6,034,313 A * 3/2000 Shelley ..... G10D 13/06 84/402
6,091,009 A * 7/2000 Simons ..... G10D 13/06 84/402
6,198,033 B1 * 3/2001 Lovelett ..... G10D 13/02 84/411 R
6,271,449 B1 * 8/2001 Enhoffer ..... G10D 13/06 84/402
6,310,277 B1 * 10/2001 Shelley ..... G10D 13/06 84/402
6,328,626 B1 * 12/2001 Eubanks ..... A01M 31/004 446/213
6,489,546 B2 * 12/2002 Enhoffer ..... G10D 13/06 84/402
6,596,933 B2 * 7/2003 Vaughn ..... G10G 5/00 84/402
D566,750 S * 4/2008 Monk ..... D17/22
7,368,648 B2 * 5/2008 van der Meulen ..... G10D 13/06 84/402
7,626,106 B2 * 12/2009 Stannard ..... G10D 13/06 84/402
7,750,220 B2 * 7/2010 Copeland ..... G10D 13/08 84/411 R
7,807,910 B1 * 10/2010 Berardo ..... G10D 13/02 84/411 R

* cited by examiner

PERCUSSION INSTRUMENT

PRIORITY

This application claims the priority benefit of U.S. Provisional Application No. 61/901,629 filed on Nov. 8, 2013, which is hereby incorporated herein by reference in its entirety.

FIELD

The present invention relates generally to musical instruments and, more particularly, to a percussion instrument.

BACKGROUND

Many different types of percussion instruments, including drums, cymbals and bells are known. However there is a continuing need to provide additional different types of percussion instruments to give musical artists additional instrumental sound variety.

SUMMARY

The present invention provides a unique percussion instrument that is struck by a drumstick and generates a sound generally resembling a cross between a cowbell and a xylophone. The instrument comprises two spaced-apart planar metal plates with three of the sides spanning between the plates enclosed by additional metal plates. The additional metal plates are welded to the spaced-apart metal plates at discreet locations to tune the instrument. An aperture for a tom mount can be disposed on one of the planar metal plates to facilitate mounting of the instrument.

Varying the locations and lengths of the welds, as well as the thickness of the plate materials, all function to change the pitch and range of pitches produced by the instrument. In certain embodiments, the instrument is approximately 32-36 inches long with one end being 6-16 inches across and the opposing end being 2-3 inches across. The spacing between the spaced-apart metal plates in certain embodiments is 1-2.5 inches. The thickness of the plate steel ranges from 18 gauge to 7 gauge. The welds connecting the edges of the spaced apart plates can be formed in number and location to generate a plurality of different pitches, for example, five different pitches.

In one example embodiment, a percussion instrument is provided. The instrument includes a top planar plate, bottom planar plate, side plates end plates and a plurality of welds. The top plate includes a first end, a second end, a front side and a rear side. The bottom planar plate has the same dimensions as the top planar plate, is spaced apart from the top planar plate, and is oriented parallel to the top planar plate. The front side plate spans between the top and bottom planar plates, and extends from the first end to the second end of the top planar plate. The first end plate spans between the top and bottom planar plates, and extends from the front side to the rear side of the top planar plate. The second end plate spans between the top and bottom planar plates, and extends from the front side to the rear side of the top planar plate. The rear plate spans between the top and bottom planar plates, and extends from the first end towards the second end to define an acoustic gap spanning between the second end and the rear plate. The plurality of spaced-apart welds disposed along an intersection of the front plate with the top planar plate.

The first end and the second end of the top plate cab both intersect the front side at right angles. The first end and the second end can both intersect the rear side at oblique angles.

Each of the top plate, bottom plate, first end plate, second end plate and rear plate can comprise a metal material.

The instrument can be mounted as part of a drum set via a tom mount secured to the bottom plate and located nearer to the second end than to the first end.

In one arrangement, the plurality of spaced-apart welds includes a first weld disposed adjacent to the first end, a second weld disposed adjacent to the second end, and third and fourth welds disposed between the first and second welds. In another embodiment, at least six welds can be provided to define at least five different tonal regions between adjacent pairs of the plurality of spaced-apart welds.

In certain example embodiments, the first end is between 2 and 3 inches long, the second end is between 6 and 16 inches long and the front side is between 32 and 36 inches long.

The top plate, the bottom plate, the front side plate, the first end plate, the second end plate and the rear plate can each have a metal material thickness of 18 gauge to 7 gauge.

In another embodiment, a method of generating a musical note is provided. The percussion instrument as described herein is struck in a first location on the top plate to generate a first audible tone and struck in a second different location on the top plate to generate a second audible tone. The second audible tone is different than the first audible tone. Additional different locations can be struck to generate other different audible tones depending on the number of spaced-apart welds employed along the along the intersection of the front plate with the top planar plate. In certain embodiments, the number of the plurality of spaced-apart welds is one greater than the number of different audible tones generated by the percussion instrument.

In a further example embodiment a system for generating a plurality of different music pitches when struck is provided. A top plate is provided and includes a first end, a second end, a front side and a rear side. The first end and the second end both intersect the front side at right angles. A bottom plate is provided and is spaced apart from the top plate and has the same dimensions and shape as the top plate. A front side plate spans between the top and bottom plates, and extends from the first end to the second end of the top plate. A first end plate spans between the top and bottom plates, and extends from the front side to the rear side of the top plate. A second end plate spans between the top and bottom plates, and extends from the front side to the rear side of the top plate. A rear plate spans between the top and bottom plates, and extends from the first end towards the second end to define an acoustic gap between the second end and the rear plate. A plurality of spaced-apart welds are disposed along an intersection of the front plate with the top planar plate.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
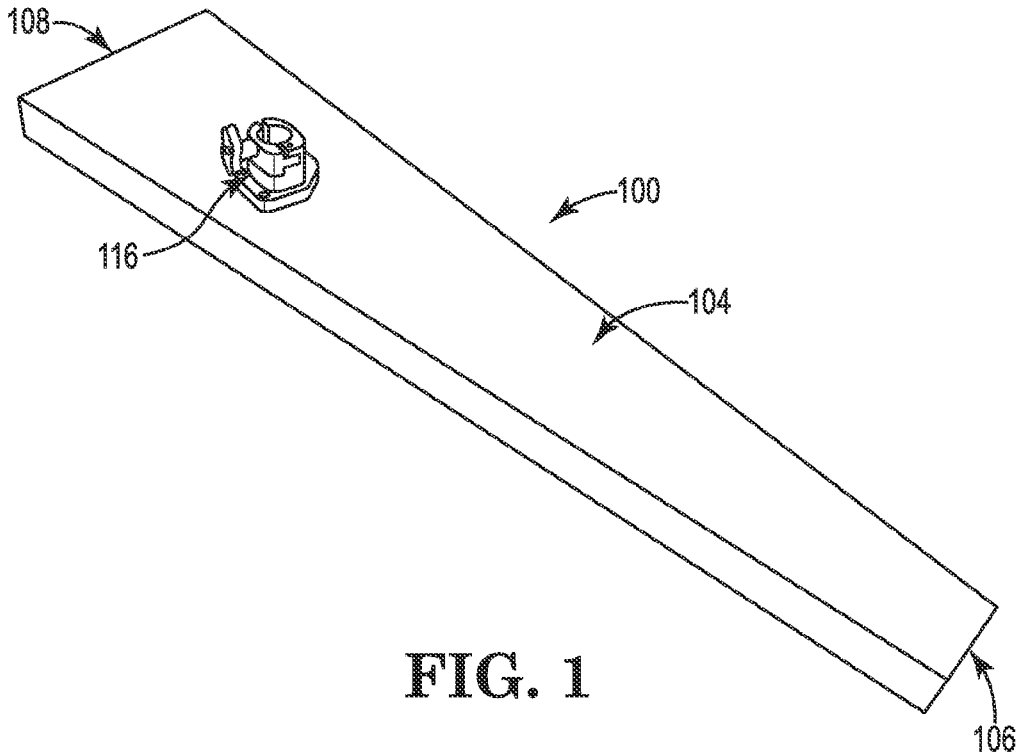
FIG. 1 is a perspective view of a percussion instrument according to certain example embodiments.
Figure 2:
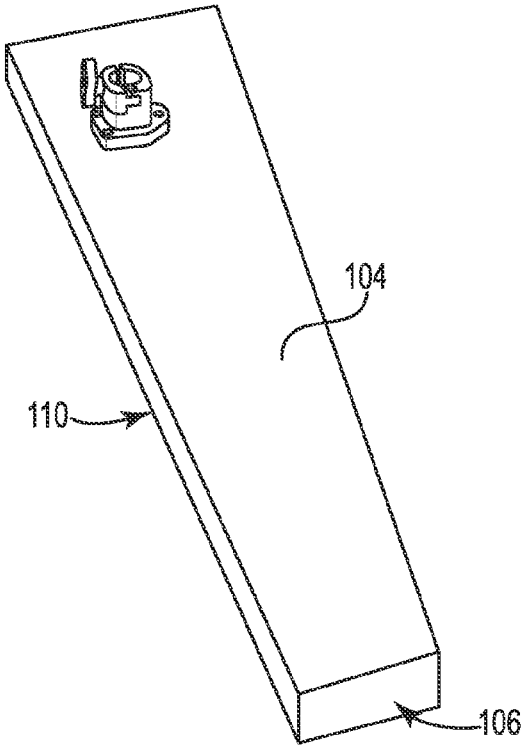
FIG. 2 is a perspective view of a percussion instrument according to certain example embodiments.
Figure 3:
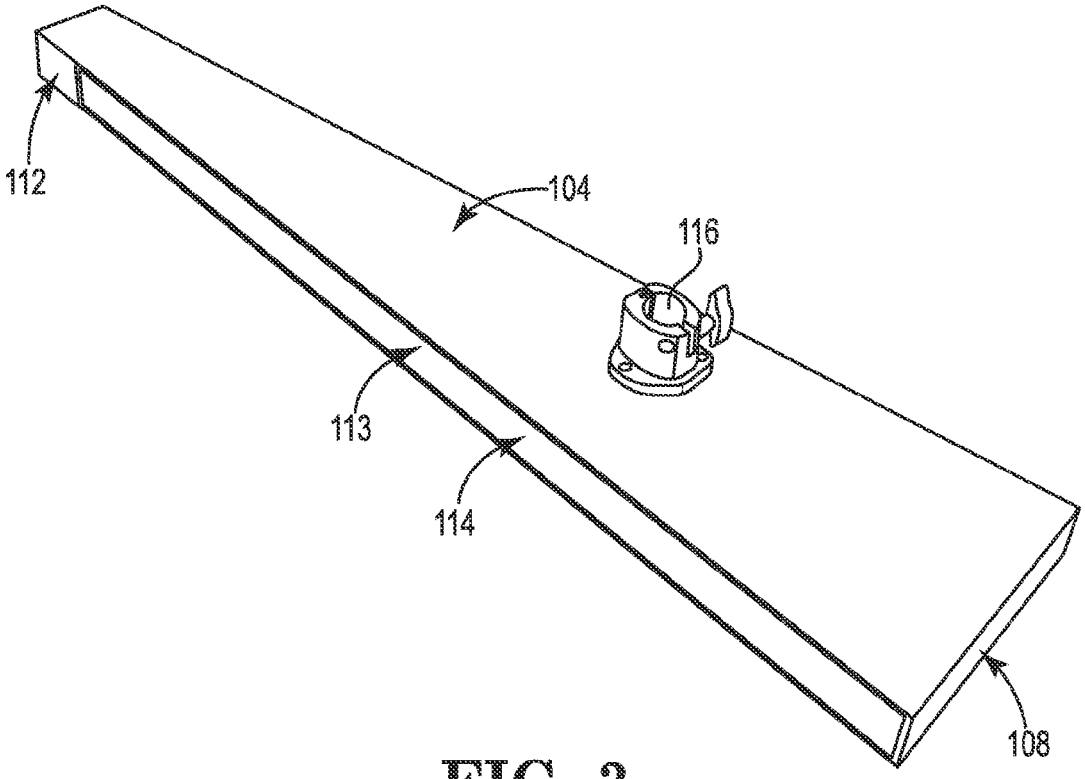
FIG. 3 is a perspective view of a percussion instrument according to certain example embodiments.
Figure 4:
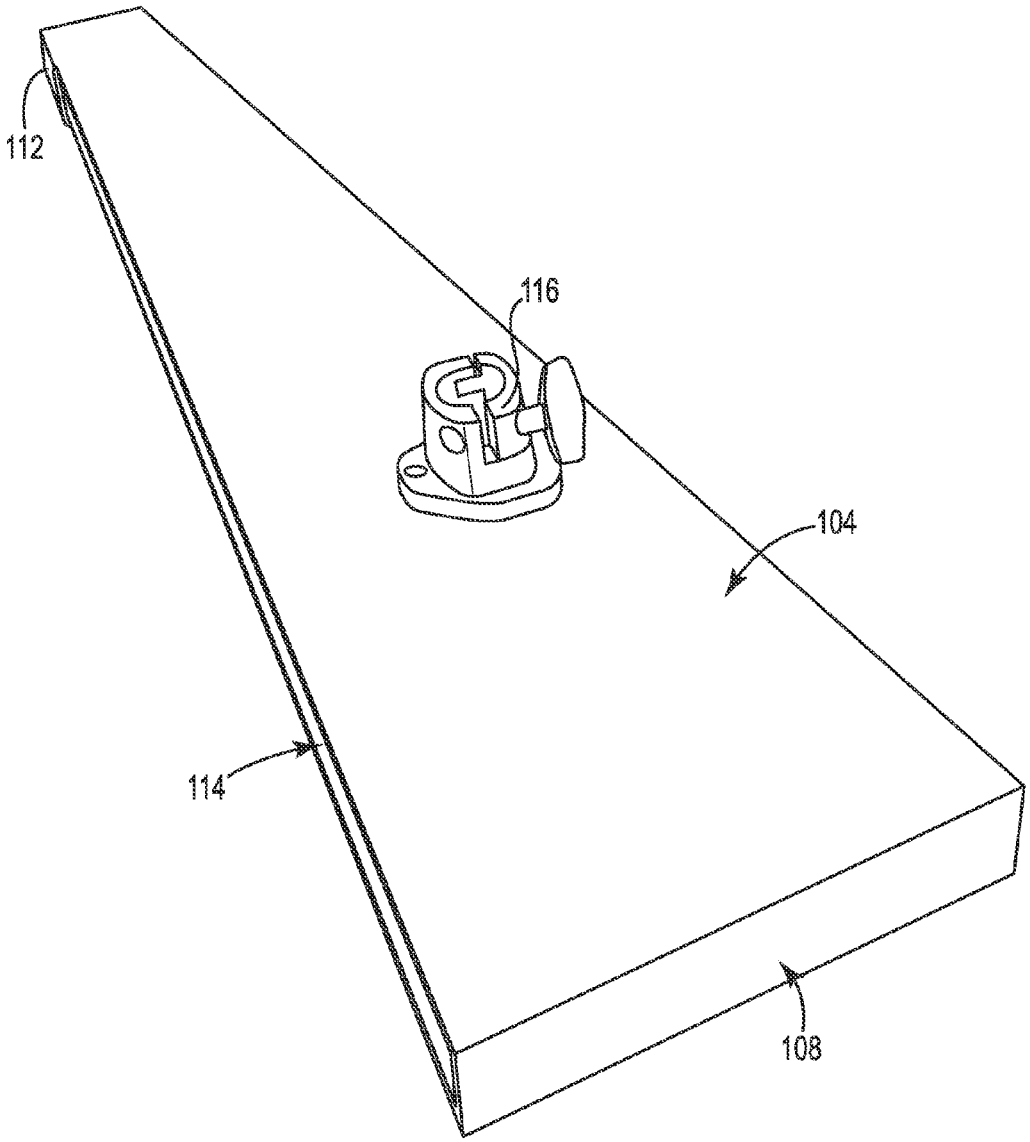
FIG. 4 is a perspective view of a percussion instrument according to certain example embodiments.
Figure 5:
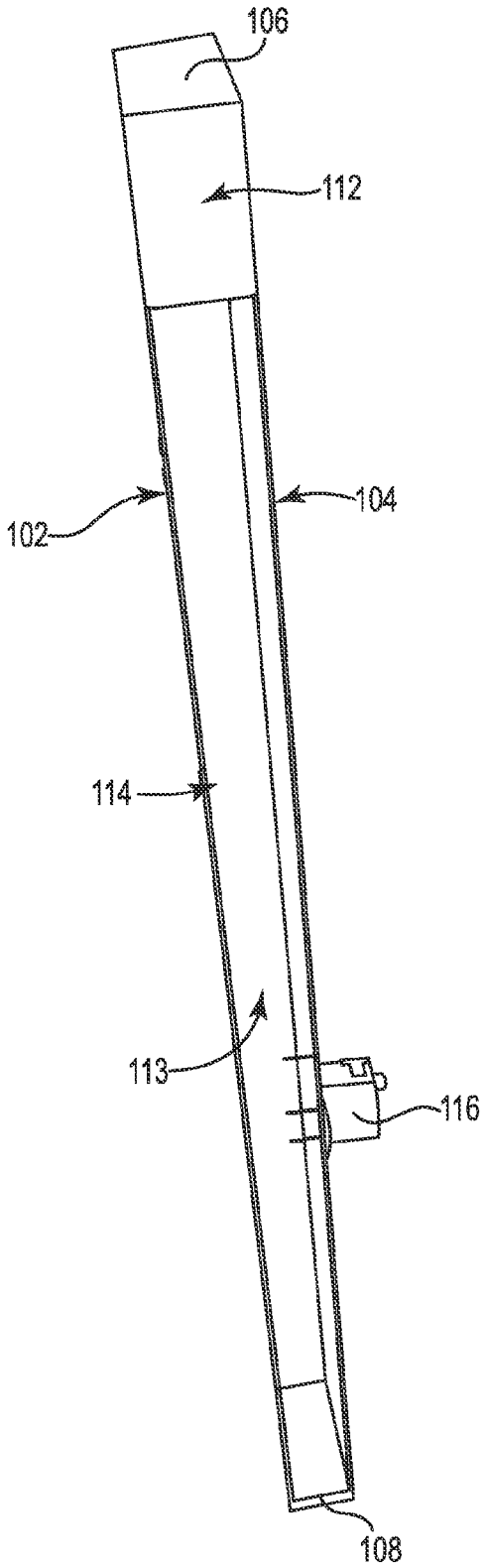
FIG. 5 is a rear side perspective view of a percussion instrument according to certain example embodiments.
Figure 6:
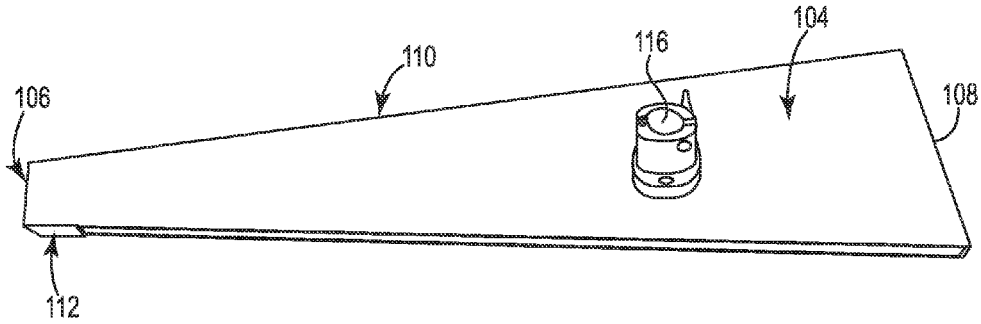
FIG. 6 is a bottom side perspective view of a percussion instrument according to certain example embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Referring to FIGS. 1-6, the musical percussion instrument 100 generally comprises a first flat metal plate 102 and a second flat metal plate 104 forming the batter (top) 102 and mounting (bottom) 104 sides of the instrument, respectively. The plates 102 and 104 are spaced apart from one another and in parallel alignment. Each plate 102 and 104 also has the same shape and dimensions.

Each of the minor side edges of the respective plates are joined by a respective first 106 and second 108 end plate. These end plates 106, 108 span the extent of each side. The respective first major or front side edges of each plate are spanned by a front side plate 110. The front plate 110 extends to the extents of the front or major side. The respective second major or rear side edges of each plate are spanned by a rear side plate 112. The rear side plate 112 spans or extends to only a portion of the length of the rear side. Thus, the top plate 102, bottom plate 104, first end plate 106, second end plate 108 front plate 110 and rear plate 112 together form a three-dimensional object having an open interior or chamber 113 and an acoustic opening or aperture 114 defined in a portion of the rear side.

In particular embodiments, the acoustic opening 114 spans between the respective top 102 and bottom 104 plates and between the rear side plate 112 and the first end plate 106. The rear side plate 112 spans between the respective top 102 and bottom 104 plate edges and from the second end side plate 108 to the opening 114.

Each of the first end plate 106, second end plate 108, front side plate 110 and rear side plate 112 intersect each of the top 102 and bottom 104 plates at a right angle.

The percussion instrument 100 can be mounted on a drum set via a tom mount 116 or other suitable mounting means. The instrument 100 can also be provided individually instead of being part of a drum set. The instrument 100 can further be set on a standing frame.

The various metal plates forming the instrument 100 are preferably made from carbon steel. This material has been found to reliably hold its original shape (no bending or deformation) with repeated use. Although, a different type of metal, metal alloy, or a rigid non-metal material, can be used to generate different tonal properties. The preferred metal thickness for carbon steel ranges between 7 and 18 gauge.

Figure 7:
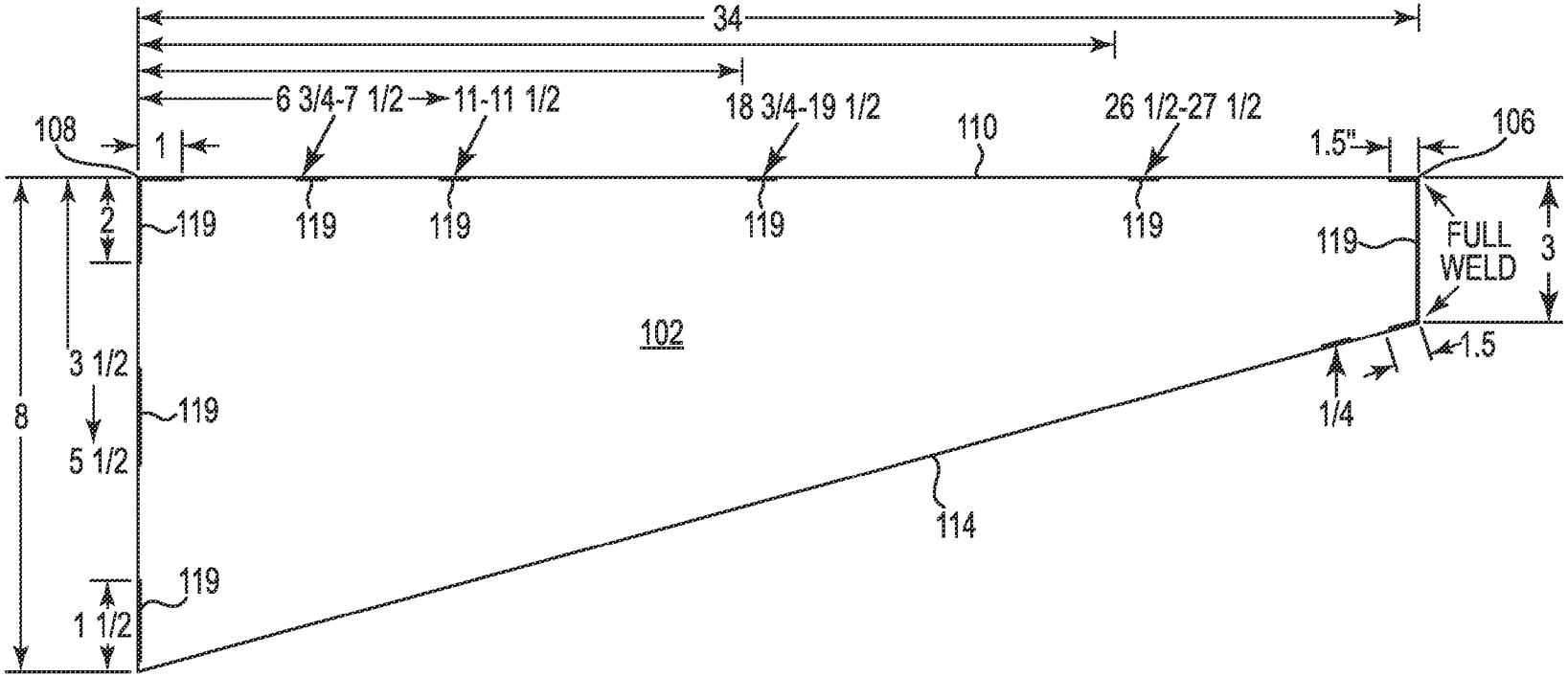
FIG. 7 is a top plan view of a batter side of a percussion instrument according to certain example embodiments.

Referring now to FIG. 7, the top plate 102 is shown in plan view. The plate is solid and continuous. The first major side edge 118 intersects the first end 120 and second end 122 at right angles. The first end 120 has a smaller width than the opposing second end 122. The second major side 124 intersects the ends 120 and 122 at oblique angles.

Figure 8:
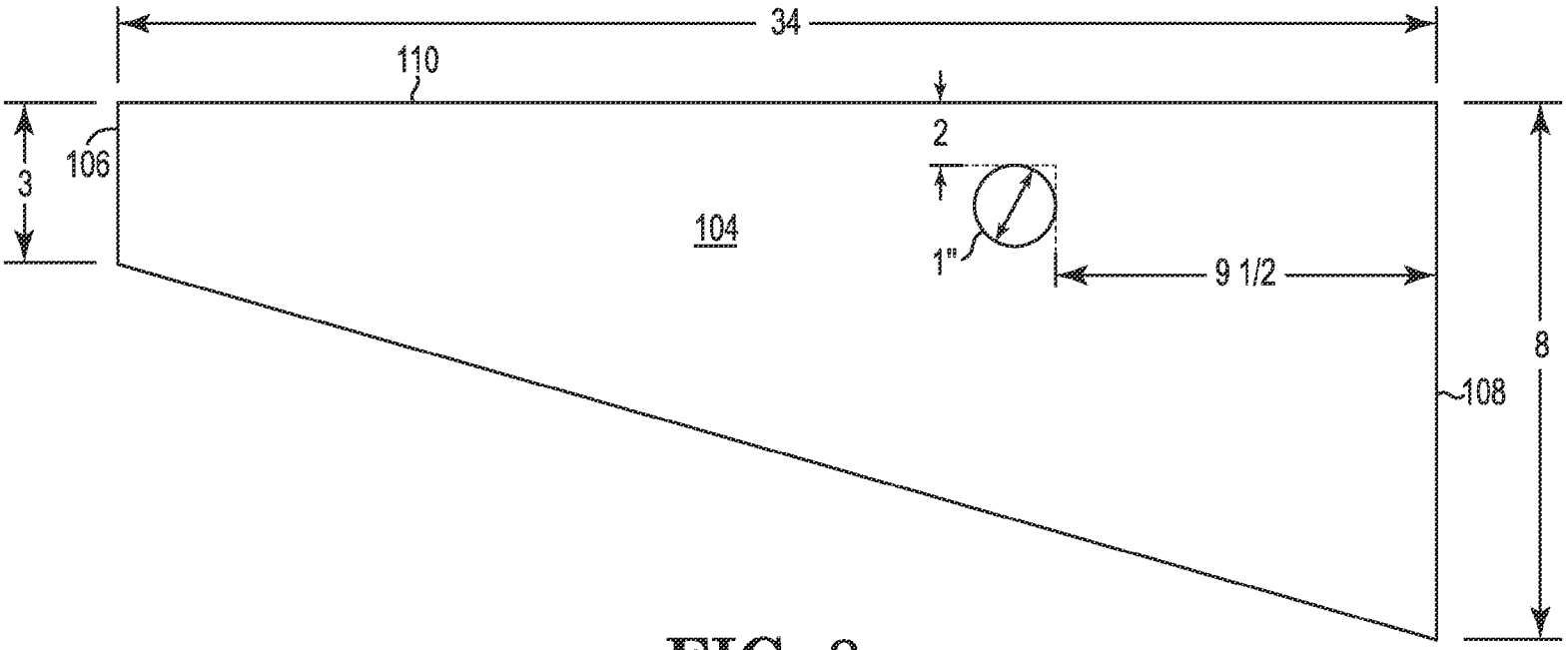
FIG. 8 is a bottom side view of a mounting side of a percussion instrument according to certain example embodiments.

Referring now to FIG. 8, the bottom plate 104 has the same dimensions as the top plate. Therefore, the respective edges are designated identically as described for the top plate. The mounting location for the tom mount (if used) is identified in FIG. 8. The tom mount can be fastened to the bottom plate via screws, rivets, or other suitable means. The bottom plate is solid and continuous other than any holes for receiving mounting hardware.

Figure 9:
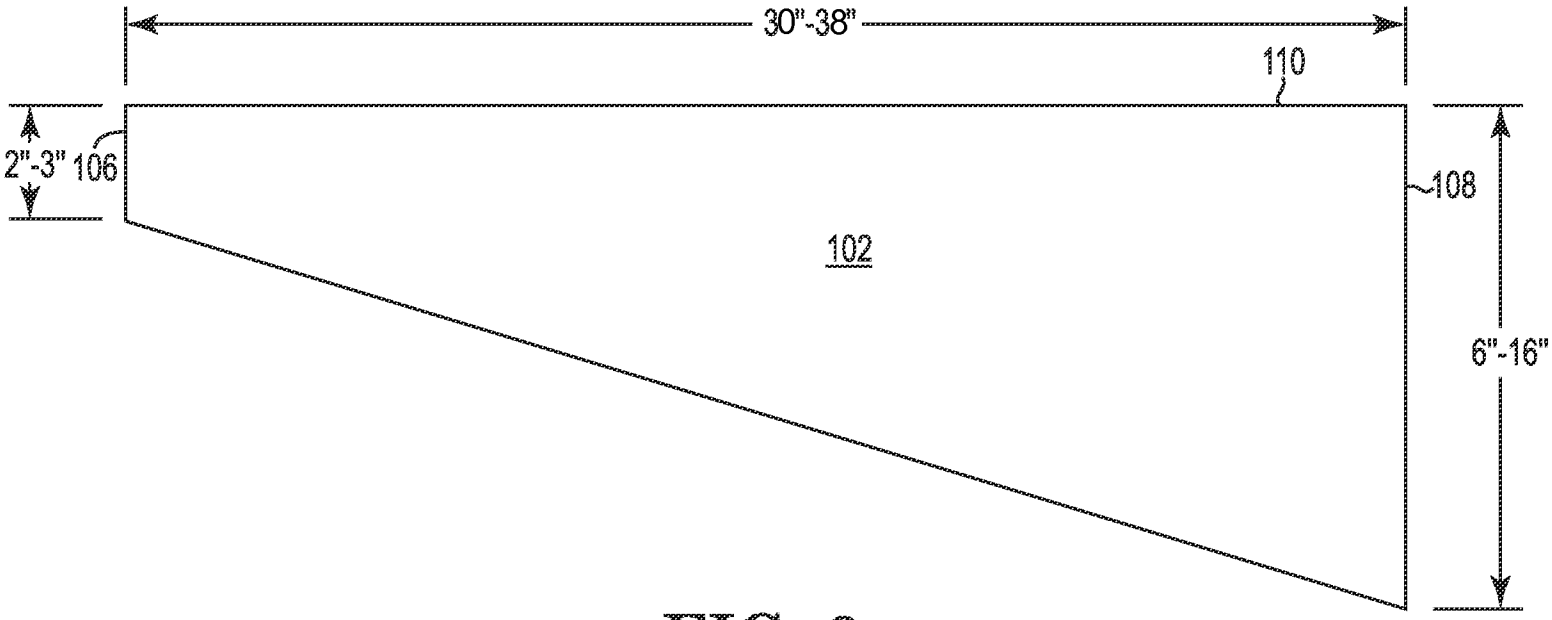
FIG. 9 is a top side view of a plate of a percussion instrument according to certain example embodiments.

FIGS. 7-9 indicate various dimensions (in inches) for the first 102 and second 104 flat plates. Again, these dimensions are merely exemplary of a range that the inventor has found to produce pleasant sounds. The spacing between the top plate 102 and bottom plate 104 (i.e. the height of the various side plates 106, 108, 110 and 112) in a preferred embodiment can range between 1 and 2.5 inches. Note that the dimensions can be scaled up and down from that shown and described, or even altered, without departing from the scope of the invention, unless specific dimensions are recited in a given claim.

The various side plates 106, 108, 110 and 112 are welded to the top 102 and bottom 104 metal plates at discreet locations to create the desired pitch and number of tones that the percussion instrument 100 can produce. FIG. 7 illustrates one example embodiment wherein the placement of the welds 119 generates five distinct different pitches that have been found to be pleasing the ear. This figure illustrates both the placement of the welds 119 and the length of the welds 119. The same weld placement and lengths are replicated for the attachment of the sides to the bottom side plate 104 as well. Of course, the weld size, number and locations can be varied in certain embodiments if different tones and number of pitches are desired.

In use the invention can be used as an addition to the drum set for drummers or as a stand-alone instrument by a performer. The invention expands the sound and dynamics of the drummer's (or a band's) musical experience and performance capabilities. The performer creates the unique sounds produced by the instrument by contacting the batter side with a drumstick or similar object with a force sufficient to produce a sound with the desired loudness. Hitting the batter side in different locations can produce different pitches or notes depending on the arrangement and size of the welds.

For example, the configuration disclosed in FIGS. 7-8 will produce five different pitches depending on which portion of the front side is being struck. The welds define the boundaries of a given pitch region. Thus, the number of pitch regions will be defined as the number of welds minus one, assuming that two adjacent welds are spaced apart to define a non-welded length there between. Then, the musician can choose which pitch to create by striking the region between welds corresponding to the chosen pitch.

The pitches can be configured to correspond to standard musical notes.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A percussion instrument, comprising:

a top planar plate, including a first end, a second end, a front side and a rear side;

a bottom planar plate having the same dimensions as the top planar plate, being spaced apart from the top planar plate, and being oriented parallel to the top planar plate;

a front side plate spanning between the top and bottom planar plates, and extending from the first end to the second end of the top planar plate;

a first end plate spanning between the top and bottom planar plates, and extending from the front side to the rear side of the top planar plate;

a second end plate spanning between the top and bottom planar plates, and extending from the front side to the rear side of the top planar plate;

a rear plate spanning between the top and bottom planar plates, and extending from the first end towards the second end to define an acoustic gap spanning between the second end and the rear plate; and a plurality of spaced-apart welds disposed along an intersection of the front side plate with the top planar plate.

2. The percussion instrument of claim 1, wherein the first end and the second end both intersect the front side at right angles.

3. The percussion instrument of claim 1, wherein the first end and the second end both intersect the rear side at oblique angles.

4. The percussion instrument of claim 1, wherein each of the top plate, bottom plate, first end plate, second end plate and rear plate comprise a metal material.

5. The percussion instrument of claim 1, further comprising a tom mount secured to the bottom plate and located nearer to the second end than to the first end.

6. The percussion instrument of claim 1, wherein the plurality of spaced-apart welds includes a first weld disposed adjacent to the first end, a second weld disposed adjacent to the second end, and third and fourth welds disposed between the first and second welds.

7. The percussion instrument of claim 1, wherein the plurality of spaced-apart welds includes at least six welds to define at least five different tonal regions between adjacent pairs of the plurality of spaced-apart welds.

8. The percussion instrument of claim 1, wherein the first end is between 2 and 3 inches long, the second end is between 6 and 16 inches long and the front side is between 32 and 36 inches long.

9. The system of claim 1, wherein the first end is between 2 and 3 inches long, the second end is between 6 and 16 inches long and the front side is between 32 and 36 inches long.

10. A method of generating a musical note, comprising:

providing a percussion instrument comprising:

a top plate, including a first end, a second end, a front side and a rear side;

a bottom plate being spaced apart from the top plate;

a front side plate spanning between the top and bottom plates, and extending from the first end to the second end of the top plate;

a first end plate spanning between the top and bottom plates, and extending from the front side to the rear side of the top plate;

a second end plate spanning between the top and bottom plates, and extending from the front side to the rear side of the top plate;

a rear plate spanning between the top and bottom plates, and extending from the first end towards the second end to define an acoustic gap between the second end and the rear plate; and a plurality of spaced-apart welds disposed along an intersection of the front side plate with the top planar plate;

striking a first location on the top plate to generate a first audible tone; and striking a second location on the top plate to generate a second audible tone, the second audible tone being different than the first audible tone.

11. The method of claim 10, further comprising striking a third location on the top plate to generate a third audible tone, the third audible tone being different than either of the first and second audible tones.

12. The method of claim 11, further comprising striking a fourth location on the top plate to generate a fourth audible tone, the fourth audible tone being different than either of the first, second and third audible tones.

13. The method of claim 10, further comprising mounting the percussion instrument on a drum set via a tom mount disposed on the bottom plate.

14. The method of claim 10, further comprising forming the top plate, the bottom plate, the front side plate, the first end plate, the second end plate and the rear plate of a metal material having a thickness of 18 gauge to 7 gauge.

15. The method of claim 10, further comprising defining the number of the plurality of spaced-apart welds to be one greater than the number of different audible tones generated by the percussion instrument.

16. A system for generating a plurality of different music pitches when struck, comprising:

a top plate, including a first end, a second end, a front side and a rear side, wherein the first end and the second end both intersect the front side at right angles;

a bottom plate being spaced apart from the top plate and having the same dimensions and shape as the top plate;

a front side plate spanning between the top and bottom plates, and extending from the first end to the second end of the top plate;

a first end plate spanning between the top and bottom plates, and extending from the front side to the rear side of the top plate;

a second end plate spanning between the top and bottom plates, and extending from the front side to the rear side of the top plate;

a rear plate spanning between the top and bottom plates, and extending from the first end towards the second end to define an acoustic gap between the second end and the rear plate; and a plurality of spaced-apart welds disposed along an intersection of the front side plate with the top planar plate.

17. The system of claim 16, wherein the first end and the second end of the top plate both intersect the rear side at oblique angles.

18. The system of claim 16, wherein each of the top plate and the bottom plate are planar and comprise a metal material.

19. The system of claim 16, further comprising a tom mount secured to the bottom plate and located nearer to the second end than to the first end.

20. The system of claim 16, wherein the plurality of spaced-apart welds includes a first weld disposed adjacent to the first end, a second weld disposed adjacent to the second end, and third and fourth welds disposed between the first and second welds.

* * * * *